US011312174B2

(12) United States Patent
Dykema

(10) Patent No.: US 11,312,174 B2
(45) Date of Patent: Apr. 26, 2022

(54) SINGLE SWEEP WHITEBOARD ERASER

(71) Applicant: WiSys Technology Foundation, Inc., Madison, WI (US)

(72) Inventor: Caleb Dykema, Allenton, WI (US)

( * ) Notice: Subject to any disclaimer, the term of this patent is extended or adjusted under 35 U.S.C. 154(b) by 0 days.

(21) Appl. No.: 16/522,254

(22) Filed: Jul. 25, 2019

(65) Prior Publication Data

US 2020/0031159 A1 Jan. 30, 2020

Related U.S. Application Data

(60) Provisional application No. 62/703,617, filed on Jul. 26, 2018.

(51) Int. Cl.

| | |
|---|---|
| ***B43L 21/00*** | (2006.01) |
| ***A47B 97/04*** | (2006.01) |
| *A47L 11/04* | (2006.01) |

(52) U.S. Cl.

CPC ..... *B43L 21/00* (2013.01); *A47B 97/04* (2013.01); *A47L 11/04* (2013.01)

(58) Field of Classification Search

CPC ..... B43L 21/00; B43L 21/04; B43L 21/02; B43L 19/0006; A46B 17/08; A46B 2200/202; A47L 11/4038; A47L 11/164; A47L 11/04; A47L 11/06; A47L 11/38; A47L 11/4061; A47L 1/02; A47L 1/00; E04H 4/1663; A47B 97/04; A47B 97/001

USPC ..... 434/411, 417; 15/246, 250.07, 98, 15/105.51, 319

See application file for complete search history.

(56) References Cited

U.S. PATENT DOCUMENTS

| | | | | |
|---|---|---|---|---|
| 3,163,943 A * | 1/1965 | Bell | B43L 21/00 | 434/417 |
| 3,731,335 A * | 5/1973 | Chrisp | B43L 21/00 | 15/97.1 |
| 2015/0099259 A1* | 4/2015 | Franco | B43L 1/00 | 434/413 |

FOREIGN PATENT DOCUMENTS

CN 201099109 Y * 8/2008

OTHER PUBLICATIONS

QRT85387—Quartet Prestige 2 Connects Full Board Eraser, https://www.amazon.com/Quartet-Prestige-Connects-Compatible-85387/dp/B00HUV3DC4.

* cited by examiner

*Primary Examiner* — Katina N. Henson

(74) *Attorney, Agent, or Firm* — Boyle Fredrickson S.C.

(57) ABSTRACT

A single sweep eraser system allows cleaning of a whiteboard with a single, simple and rapid motion across the board. The system provides track brackets and glides that support a cleaning bar applying sufficient pressure to a cleaning pad extending the height of the board to provide broad area cleaning without the need for the user to "lean in" hard against the cleaning pad. The tracks conveniently hold the cleaning bar off to one side of the board for ready access.

16 Claims, 5 Drawing Sheets

SINGLE SWEEP WHITEBOARD ERASER

CROSS REFERENCE TO RELATED APPLICATION

This application claims the benefit of U.S. Provisional Application No. 62/703,617, filed Jul. 26, 2018, hereby incorporated by reference.

BACKGROUND OF THE INVENTION

The present invention relates generally to board erasers, for example, for removing nonpermanent markings on a reusable writing surface and in particular to a single sweep eraser system supporting an extended eraser bar that erases along an entire height or width of the board at once.

Whiteboards, often called "dry erase boards," are glossy, typically white or clear surfaces for nonpermanent markings. Their smooth, nonporous outer surface allows for rapid marking and erasing on the surface. Dry erase markers are typically used with whiteboards having colored pigments with an oily silicone polymer or "release agent" which makes the dry erase ink slippery and prevents the colored pigments from adhering permanently to the whiteboard surface and making it easy to wipe off.

Whiteboards are commonly used in offices, school classrooms and meeting rooms to provide nonpermanent writing surface. Although they provide a convenient surface for writing and drawing, they can be burdensome to clean and keep fresh.

SUMMARY OF THE INVENTION

The present invention provides a single sweep eraser system that allows for cleaning of a whiteboard with a single, simple and rapid motion across the board. The system provides track brackets and glides that support a cleaning bar applying sufficient pressure to a cleaning pad extending the height of the board to provide broad area cleaning without the need for the user to "lean in" or "press" hard against the cleaning pad. The tracks conveniently hold the cleaning bar off to one side of the board for ready access and for incremental cleaning along the board.

In one embodiment, the present invention provides a whiteboard eraser system for a whiteboard having a planar nonporous writing surface for the application and removal of dry erasable marker ink, the planar surface having upper and lower edges terminating at left and right edges. A track assembly extends along at least one of the upper and lower edges of the whiteboard; a glide assembly engages with each track assembly; and an eraser bar supported by the glide assemblies at opposed upper and lower ends is slideable transversely across the whiteboard. The eraser bar has a contact plate supported by the eraser bar between the eraser bar and the writing surface, the contact plate supporting an inner cleaning pad extending the height of the planar surface, and a biasing mechanism providing a biasing force of the cleaning pad toward the writing surface.

It is thus a feature of at least one embodiment of the invention to provide single quick action sweeping of a cleaning pad over the smooth and slippery surface of a whiteboard without applying additional pressure into the whiteboard.

The inner cleaning pad may have a cleaning surface moveable between a cleaning position with the cleaning surface contacting the writing surface and a retracted position moved away from the writing surface.

It is thus a feature of at least one embodiment of the invention to provide selective cleaning of marker writings on the whiteboard surface by allowing the cleaning pad to pass over the writing surface without contact.

The biasing force may be movement of the contact plate toward the writing surface. The biasing mechanism may be compression springs arranged between the contact plate and the eraser bar. The biasing mechanism may also be foam or a spring providing compression force, e.g., torsion spring.

It is thus a feature of at least one embodiment of the invention to provide spring-loaded force against the whiteboard to apply even pressure on the cleaning pad which naturally conforms to misalignment between the whiteboard and the eraser bar.

The track assembly may include an upper track extending along the upper edge of the whiteboard and supporting movement of the glide assembly therealong, and a lower track extending along the lower edge of the whiteboard and supporting movement of the glide assembly therealong.

It is thus a feature of at least one embodiment of the invention to provide vertical alignment of the eraser bar parallel to the whiteboard to prevent misalignment between the eraser pad and the writing surface.

At least one of the upper and lower track may include a hanger extending over at least one of the upper and lower edges of the whiteboard to provide front and rear force resistance on the track assembly.

It is thus a feature of at least one embodiment of the invention to allow the eraser bar assembly to be retrofitted into pre-existing whiteboards. It is also a feature for the hanger to provide forward and backward resistance to forces on the eraser bar.

The glide assembly may further include glides engageable with the track assembly. The glides may be at least one wheel engaging opposed forward and rearward walls of the upper and lower track.

It is thus a feature of at least one embodiment of the invention to allow for a low friction sliding of the eraser bar along the smooth sliding surface of the whiteboard.

The inner cleaning pad may be removably replaceable from the eraser bar. The inner cleaning pad may provide multiple layers of eraser material which are separately removable from the cleaning pad.

It is thus a feature of at least one embodiment of the invention to provide replaceable cleaning pads to provide a more economical solution to replacing the entire eraser bar.

At least one of the upper and lower end of the eraser bar may be removably attached to the whiteboard to allow the upper and lower end to be separable from the whiteboard. At least one of the upper and lower end of the eraser bar is hingeably attached to the whiteboard to allow the upper and lower end to pivot away from the whiteboard.

It is thus a feature of at least one embodiment of the invention to allow the inner cleaning pads to be easily accessible for replacement.

A holder may be attached to the glide assembly and slideable across the whiteboard with the eraser bar.

It is thus a feature of at least one embodiment of the invention to allow the whiteboard markers to be easily accessible to the user as they travel along the whiteboard.

The track assembly may further include an outer rail receiving a strip of material including at least one of a magnetic strip and a cork strip.

It is thus a feature of at least one embodiment of the invention to allow the assembly to provide additional functions.

Present invention also provides a method for removing erasable dry erasable marker ink from a whiteboard having a planar nonporous writing surface, the planar surface having upper and lower edges terminating at left and right edges, the method comprising: attaching a track assembly extending along at least one of the upper and lower edges of the whiteboard; installing an eraser bar, supported by glide assemblies engageable with each track assembly, at opposed upper and lower ends and to be slideable transversely across the whiteboard, the eraser bar having a contact plate supported by the eraser bar between the eraser bar and the writing surface, the contact plate supporting an inner cleaning pad extending the height of the planar surface and a biasing mechanism provides a biasing force of the cleaning pad toward the writing surface; and gliding the eraser bar along the writing surface to remove the erasable marker ink.

These particular objects and advantages may apply to only some embodiments falling within the claims and thus do not define the scope of the invention.

DETAILED DESCRIPTION OF THE PREFERRED EMBODIMENT

Figure 1:
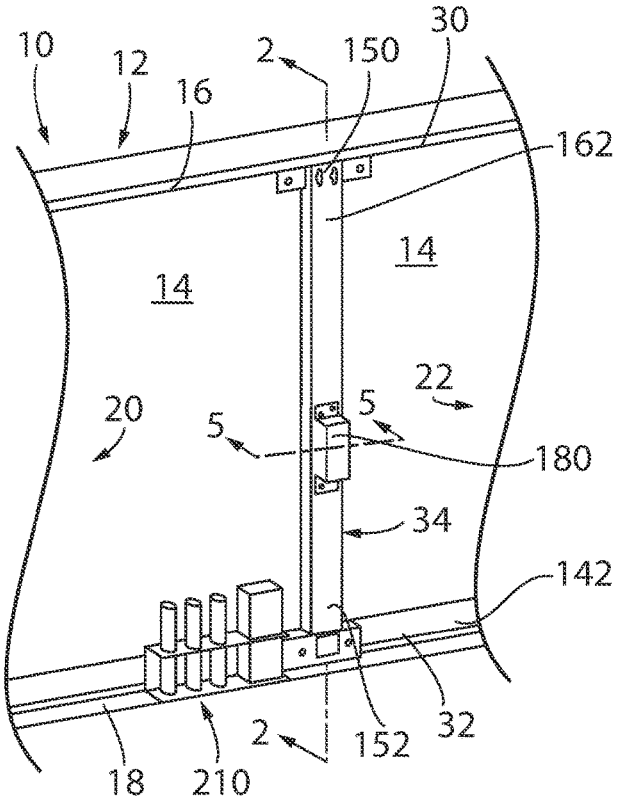
FIG. 1 is a perspective view of a whiteboard with the single sweep eraser system of the present invention attached thereto showing the extended eraser bar extending across a height of the whiteboard.

Referring now to FIG. 1, a single sweep eraser system 10 of the present invention may make use of a commercial, off-the-shelf whiteboard 12 providing a glossy, nonporous writing surface 14, for example, made of a laminated chipboard, high pressure laminate, or steel board with a white polyester or acrylic coating on a front facing planar surface. Importantly the writing surface 14 is a nonporous, non-absorbing surface to receive dry erase markers for persistent writing on the surface that can be readily removed by a wiping action.

The whiteboard 12 may be a rectangular panel extending along a substantially vertical plane of a wall or supported in a substantially vertical orientation by an easel or rolling stand (not shown), and having an upper edge 16 and lower edge 18 connected by left and right edges 20, 22 surrounding the glossy writing surface 14. The outer edges of the whiteboard 12 may include a frame, such as an aluminum frame, enclosing the whiteboard 12. In one embodiment the whiteboard 12 may have a width between 36 and 72 inches and a height between 24 and 48 inches with the width typically greater than the height to span a wall. However it is understood that the whiteboard 12 may take various sizes and dimensions.

Figure 2:
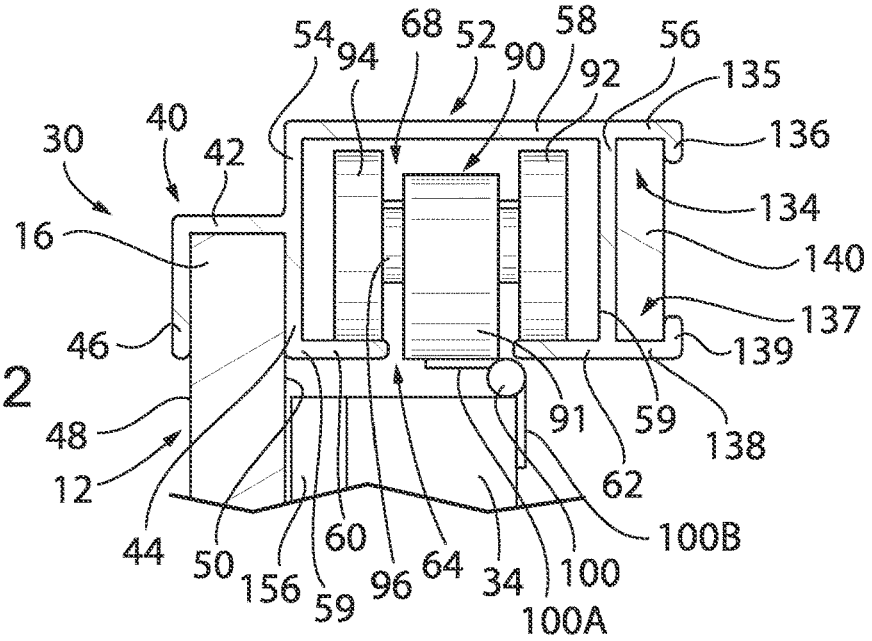
FIG. 2 is a cross-section taken along line 2-2 of FIG. 1 showing the gliding trolley of the single sweep eraser system installed on a track bracket.
Figure 3:
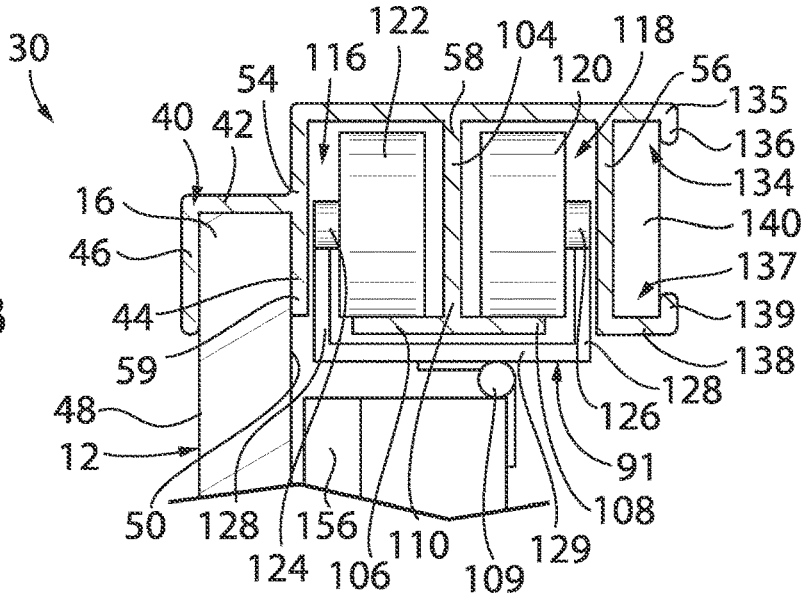
FIG. 3 is a cross-section taken along line 2-2 of FIG. 1 of an alternative embodiment of FIG. 2.

Referring also to FIGS. 2 and 3, the single sweep eraser system 10 provides an upper track bracket 30 attached to the upper edge 16 of the whiteboard 12 and a lower track bracket 32 attached to the lower edge 18 of the whiteboard 12 for providing vertical support of an eraser bar 34 extending across a height the whiteboard 12 which will be described in more detail below. The upper track bracket 30 and lower track bracket 32 extend substantially a full-width of the whiteboard 12 between the left and right edges 20, 22 of the whiteboard 12. The upper track bracket 30 and lower track bracket 32 may be manufactured of extruded aluminum and may be installed onto the whiteboard 12 as described below. It is understood that the upper track bracket 30 and lower track bracket 32 may be manufactured onto the whiteboard 12 instead of being retrofitted to an existing whiteboard 12. The upper track bracket 30 and lower track bracket 32, respectively, may be separate track segments that are attached at their ends to provide a single track extending an entire length of the whiteboard 12.

The upper track bracket 30 provides a hanger 40 supporting an upper rail 52 extending over and supported by the upper edge 16 of the whiteboard 12. The hanger 40 includes a reversed U-shaped hook having a horizontal hanger top wall 42 supporting a downwardly extending vertical hanger front wall 44 and a substantially parallel downwardly extending vertical hanger rear wall 46 at a front and rear, respectively. The horizontal hanger top wall 42 is installed over the upper edge 16 of the whiteboard 12 such that the vertical hanger rear wall 46 passes approximately 2 to 4 inches downwardly along an upper end of the rear side 48 of the whiteboard 12 while the hanger front wall 44 extends parallel and passes downwardly approximately 2 to 4 inches along an upper end of the front side 50 of the whiteboard 12. The vertical hanger rear wall 46 supports the forward weight of the eraser bar 34.

Referring specifically to FIG. 2, the vertical hanger front wall 44 further supports an upper rail 52 for supporting gliding movement of the eraser bar 34 along a width of the whiteboard 12. The upper rail 52 may extend substantially a full-width of the whiteboard 12 between the left and right edges 20, 22 of the whiteboard 12 to allow a low friction surface for gliding therealong.

The upper rail 52 includes a vertical rail rear wall 54 extending upwardly from the vertical hanger front wall 44 and substantially parallel to a vertical rail front wall 56 supported at their upper ends by a horizontal rail top wall 58. A lower end 59 of the vertical rail rear wall 54 and vertical rail front wall 56 further support inwardly extending horizontal flanges 60, 62, respectively, the rear flange 60 extending forwardly and the front flange 62 extending rearwardly. The flanges 60, 62 define a track supporting gliding support of a glide assembly 90 of the eraser bar 34 on the flanges 60, 62 as further described below. In this respect, a rectangular channel 68 is formed between the vertical rail rear wall 54, vertical rail front wall 56, horizontal rail top wall 58, and horizontally extending flanges 60, 62 allowing the glide assembly 90 of the eraser bar 34 to slide therein. A longitudinal gap 64 is formed between the forwardly and rearwardly extending flanges 60, 62 permitting a trolley bracket 91 of the glide assembly 90 supporting the eraser bar 34 to hang downwardly therebetween.

Referring still to FIG. 2, the eraser bar 34 may be supported on the upper rail 52 by the glide assembly 90 having glides providing a low friction rolling or sliding surface, such as opposed front and rear wheels 92, 94, respectively, separated by and rotated about a horizontally extending axle 96 extending along an axis between the vertical rail rear wall 54 and vertical rail front wall 56. The front and rear wheels 92, 94 are held within the rectangular channel 68 to engage and roll along the inwardly extending flanges 60, 62 approximately an entire length of the upper rail 52. The axle 96 supports a downwardly extending trolley bracket 91 extending downwardly through the gap 64 between the flanges 60, 62 and supporting the eraser bar 34 hanging therefrom. Optionally, a hinge 100 having a first wing (100A) and a second wing (100B) may be provided between the downwardly extending trolley bracket 91 and the eraser bar 34 to allow the eraser bar 34 to pivot upwards when a bottom end 102 of the eraser bar 34 is detached as further discussed below.

While only one pair of front and rear wheels 92, 94 can be seen in the cross section of FIG. 2, it is understood that the glide assembly 90 may include two or more pairs of front and rear wheels 92, 94 arranged along a top end of the eraser bar 34 to facilitate gliding of the eraser bar 34, especially to support a width of the eraser bar 34 that is greater than a width of the wheels 92, 94. The multiple pairs of front and rear wheels 92, 94 may be positioned at the outer edges of a width of the eraser bar 34.

Referring now specifically to FIG. 3, in an alternative embodiment, the upper rail 52 may take a different configuration corresponding with a different configuration of the glide assembly 90. In this alternative embodiment, instead of the vertical rail rear wall 54 and vertical rail front wall 56 supporting inwardly horizontally extending flanges 60, 62, the horizontal rail top wall 58 may support a downwardly extending divider wall 104 centered between the vertical rail rear wall 54 and vertical rail front wall 56 and having a rearwardly extending flange 106 and a forwardly extending flange 108 at a lower end 110 supporting the glide assembly 90 of the eraser bar 34 thereon. In this respect, a first rectangular channel 116 is formed between the vertical rail rear wall 54, horizontal rail top wall 58, divider wall 104 and rearwardly extending flange 106, and a second rectangular channel 118 is formed between the horizontal rail top wall 58, divider wall 104, and forwardly extending flange 108, allowing the glide assembly 90 of the of the eraser bar 34 to slide therein. A rear gap 112 between the vertical rail rear wall 54 and the rearwardly extending flange 106 and a front gap 114 between the vertical rail front wall 56 and the forwardly extending flange 108 permit a trolley bracket 91 of the glide assembly 90 to hang downwardly therefrom.

Referring still to FIG. 3, the glide assembly 90 in accordance with the alternative embodiment of the upper rail 52 may include front and rear wheels 120, 122 respectively with the rear wheel 122 supported by a rear axle 124 extending rearwardly toward the vertical rail rear wall 54, and the front wheel 120 supported by a front axle 126 extending forwardly toward the vertical rail front wall 56. The rear axle 124 and front axle 126 may be further supported by trolley bracket 91 having vertical supports 128 extending downwardly from the axles through the rear gap 112 and the front gap 114, respectively, and joining a horizontal support 129 extending below the downwardly extending divider wall 104 and outwardly extending flanges 106, 108. The horizontal support 129 may further carry the eraser bar 34 hanging therefrom. Optionally, a hinge 109 may be provided between the horizontal support 129 and the eraser bar 34 to allow the eraser bar 34 to pivot upwards when a bottom end 102 of the eraser bar 34 is unattached as further discussed below.

While only one pair of front and rear wheels 120, 122 can be seen in the cross section of FIG. 3, it is understood that the glide assembly 90 may include two or more pairs of front and rear wheels 120, 122 arranged along a top end of the eraser bar 34 to facilitate gliding of the eraser bar 34, especially to support a width of the eraser bar 34 that is greater than a width of the wheels 120, 122. The multiple pairs of front and rear wheels 120, 122 may be positioned at the outer edges of a width of the eraser bar 34.

Figure 4:
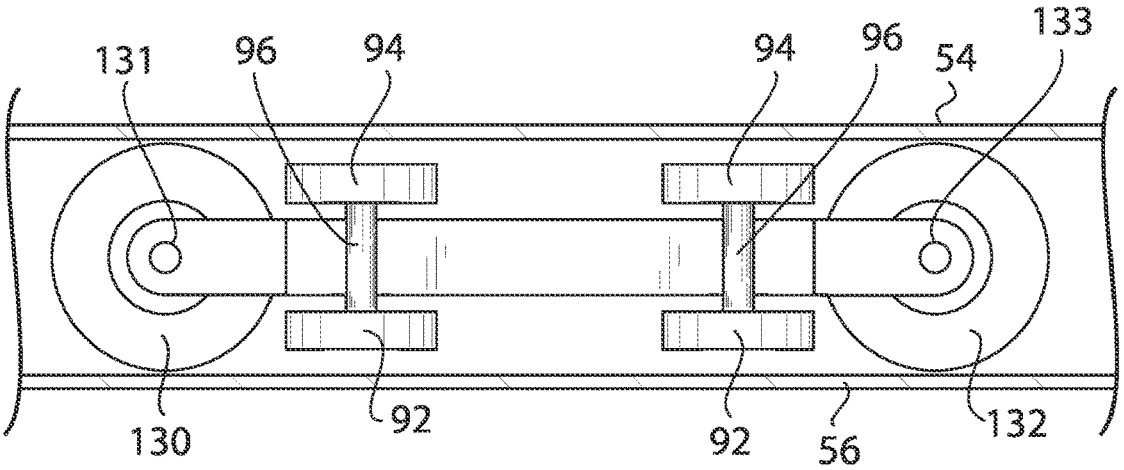
FIG. 4 is a top elevation view of an alternative embodiment of the gliding trolley of the single sweep eraser system.

Referring to FIGS. 2 and 4, the glide assembly 90 may include additional glides, for example, may be similar to the glide assembly shown in FIG. 2 but providing an additional set of wheels 130, 132, for example, flanking the front and rear wheels 92, 94 in FIG. 2 and rotating about respective vertical axes 131, 133 extending perpendicular to the axes of the front and rear wheels 92, 94 and engaging with the vertical rail rear wall 54 and vertical rail front wall 56 to stabilize a forward and rearward position of the glide assembly 90 with respect to the upper rail 52. The wheels 130, 132 assist to balance out the forward and rearward forces applied to and by the eraser bar 34 thereby maintaining a constant vertical orientation.

In a similar manner, additional sets of wheels 130, 132 rotating about vertical axes may be applied with respect to the embodiment of FIG. 3 whereby a first set of wheels may be arranged to contact the side walls of the first rectangular channel 116 and a second set of wheels may be arranged to contact the side walls of the second rectangular channel 118. In a similar manner, the wheels assist to balance out the forward and rearward forces applied to and by the eraser bar 34 thereby maintaining a constant vertical orientation.

Referring again to FIGS. 2 and 3, the vertical rail front wall 56 may further provide an upper groove 134 provided by a forwardly extending lip 135 with a downwardly extending flange 136 and a lower groove 137 provided by a forwardly extending lip 138 with an upwardly extending flange 139. The upper groove 134 and lower groove 137 may support therein a strip of material 140 extending along a length of the upper track bracket 30 such as a cork or magnetic strip.

The lower track bracket 32 may provide a lower rail 142 supported by the lower edge 18 of the whiteboard 12 in a similar manner as the upper track bracket 30 described above with respect to FIGS. 2 through 4 except with the upper rail 52 and glide assembly 90 reversed as would be understood by one having ordinary skill in the art. In this respect, the upper track bracket 30 and the lower track bracket 32 may be identical but installed on opposite upper and lower ends of the whiteboard 12.

It is understood that the upper track bracket 30 and the lower track bracket 32 may take different configurations such as a grooved channel, for example, having a T cross-section, and receiving an alternative glide assembly 90, for example, receiving corresponding T-shaped plastic sliders such as nylon, teflon or ultrahigh molecular weight polyethylene slides instead of wheels while still providing low friction gliding motion of the eraser bar 34 along the upper and lower track brackets 30, 32. It is understood that the upper track bracket 30, the lower track bracket 32, and the glide assembly 90 provide low friction sliding or rolling of the eraser bar 34 along a width of the whiteboard 12.

It is understood that while various embodiments of the upper rail 52 and lower rail 142 and glide assembly 90 are shown for illustrative purposes, other configurations of the upper rail 52, lower rail 142 and glide assembly 90 may be implemented for gliding movement of the eraser bar 34. The upper rail 52, lower rail 142 and glide assembly 90 also assist to maintain a vertical alignment of the eraser bar 34 with the whiteboard 12 so that the eraser bar is parallel to the whiteboard 12 and in close alignment with the writing surface 14 of the whiteboard 12. In this respect the upper and lower track brackets 30, 32 and glide assemblies 90 described above may take many different configurations without departing from the spirit of the invention.

Figure 5:
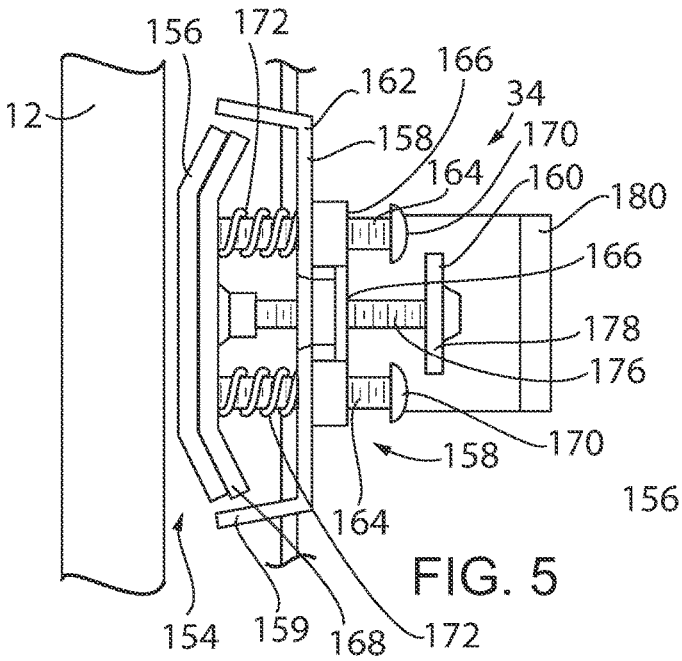
FIG. 5 is a cross-section taken along line 5-5 of FIG. 1 showing the eraser bar of the single sweep eraser system in a retracted position.

Referring to FIGS. 1 and 5, the eraser bar 34 may provide for a vertically extending beam having an upper end 150 supported in fixed vertical alignment by the glide assembly 90 engaged with the upper rail 52 at the top of the whiteboard 12 opposite a lower end 152 engaging the lower rail 142 of the bottom of the whiteboard 12.

The eraser bar 34 may include an inner surface 154 supporting a cleaning pad 156 contacting the whiteboard 12 in an extended, cleaning position to clean erasable markings on the whiteboard 12 and an outer surface 158 supporting a pull handle 160 moving the cleaning pad 156 from the extended, cleaning position to a retracted position when it is not desired that the cleaning pad 156 contact the whiteboard 12. The cleaning pad 156 and eraser bar 34 may extend substantially a full height of the whiteboard 12 between the upper and lower edges 16, 18 of the whiteboard 12 to wipe clean substantially the entire board when the eraser bar 34 is moved along a width of the whiteboard 12. In one embodiment, the cleaning pad 156 and eraser bar 34 has a height between 24 and 48 inches and a width between 2 and 4 inches.

Referring to FIG. 5, the eraser bar 34 may include a front faceplate 162 providing a substantially flat outer surface 158 of the eraser bar 34 attached to the glide assembly having outwardly flared lateral edges 159 and engaging with a compression plate 168 nested behind the faceplate 162. The compression plate 168 may provide the inner surface 154 of the eraser bar 34 and may support the cleaning pad 156 on the inner surface 154.

The cleaning pad 156 may be a dry eraser material made of a dry, flexible fabric such as soft felt, soft pile material or microfiber cloth that allows the markings such as ink from a dry erase marker to be wiped away and absorbed into the material. The cleaning pad 156 may include removable, disposable layers of eraser material whereby the outer layer may be peeled off to reveal a clean inner layer of eraser material once the outer layer is saturated with ink. Once all of the layers of the cleaning pad 156 have been removed, a new cleaning pad 156 may be attached to the inner surface 154 of the compression plate 168. The cleaning pad 156 may be attached to the compression plate 168 by Velcro or other known adhesive materials.

The compression plate 168 may support a number of bolts 164 attached thereto and extending forwardly through a number of corresponding openings 166 of the faceplate 162. The bolts 164 pass through the openings 166 of the faceplate 162. The faceplate 162 is retained by the bolts 164 by the broader bolt heads 170 at the distal ends of the bolts 164 which are larger than the openings 166 and unable to pass through the openings 166.

The compression plate 168 is biased away from the faceplate 162 by a number of compression springs 172 carried by and around the bolts 164 between the compression plate 168 and faceplate 162 and opposing compression of the compression plate 168 towards the faceplate 162. A length of the bolts 164 define a maximum distance of rearward extension of the compression plate 168 away from the faceplate 162. In this respect, in a relaxed state, the compression plate 168 is biased away from the faceplate 162 and towards the whiteboard 12 in an extended, cleaning position.

The multiple compression springs 172 apply an even rearward pressure onto the whiteboard 12 to naturally align the eraser bar 34 with the whiteboard 12. For example, the compression springs 172 continue to press the cleaning pad 156 into the whiteboard 12 as layers of the cleaning pad 156 are removed.

Figure 6:
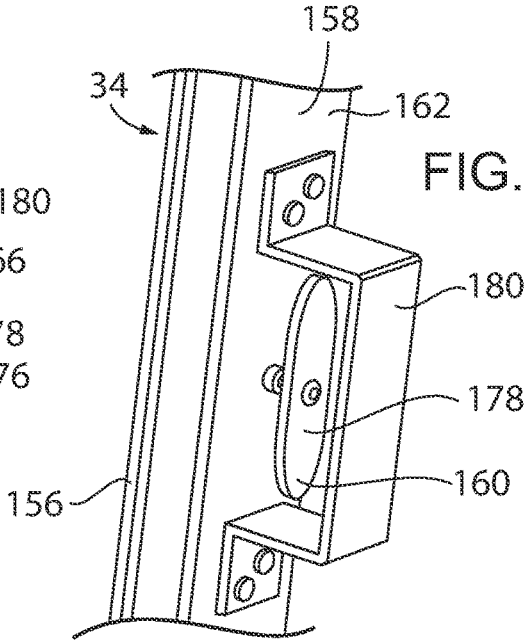
FIG. 6 is an outer perspective view of the eraser bar showing the eraser bar pull handle in a cleaning position.

Referring to FIGS. 5 and 6, a pull handle 160 may be attached to the eraser bar 34 towards a center of the eraser bar 34. The pull handle 160 may include a shaft 176 attached to the compression plate 168 and extending through an opening 166 of the faceplate 162 to provide a T-knob 178 at a distal end of the shaft 176 to allow the pull handle 174 to be pulled in a forward direction thereby moving the compression plate 168 towards the faceplate 162 against the opposing force of the compression springs 172. In this respect the compression plate 168 is pulled toward the faceplate 162 and away from the whiteboard 12 in a retracted position and against the biasing force.

A U-shaped outer handgrip 180 may extend over the T-knob 178 to facilitate the pulling action of the T-knob 178 toward the outer handgrip 180. In this respect a user's fingers may pull the knob T-knob 178 towards the outer handgrip 180 held within the user's palm by bending the fingers toward the palm.

Additionally, the outer handgrip 180 may be used to slide the eraser bar 34 along the smooth outer writing surface 14 of the whiteboard 12 in a manner which provides contact of the cleaning pad 156 with the whiteboard 12. The user may slide the eraser bar 34 along the width of the whiteboard 12 with minimal to no additional rearward force as the compression springs 172 applies the rearward force against the cleaning pad 156 onto whiteboard 12.

Figure 7:
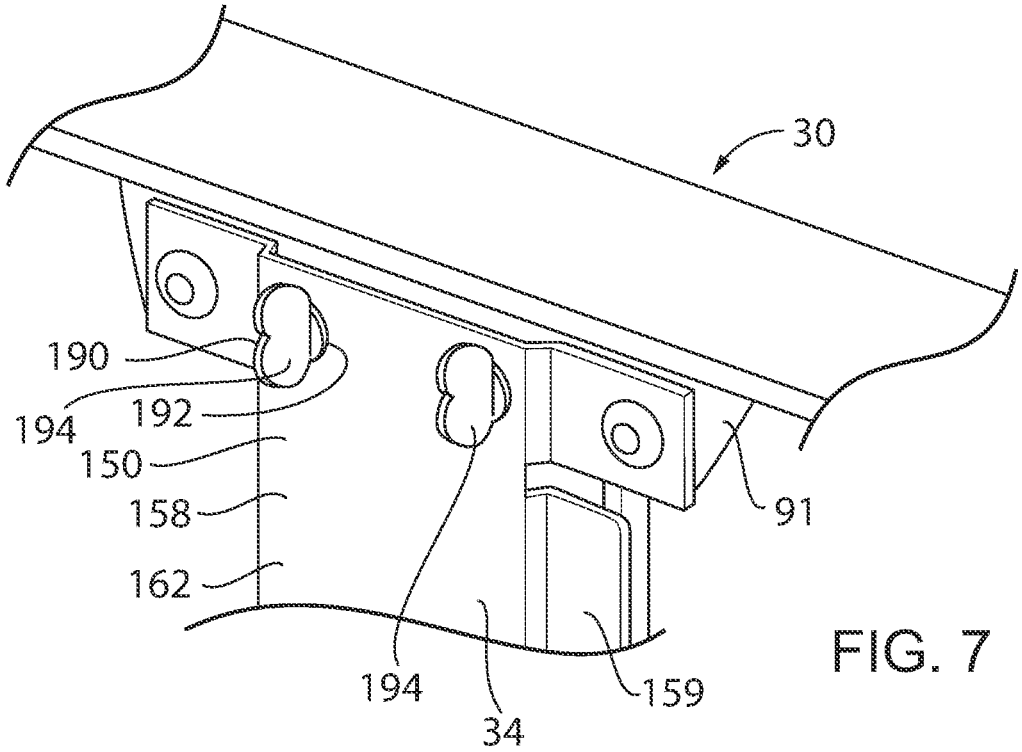
FIG. 7 is an outer perspective view of a top of the eraser bar showing fasteners permitting release of a top end from an upper track bracket.

Referring to FIGS. 1 and 7, the upper end 150 of the eraser bar 34 may be releasably attached to the glide assembly 90 to allow the upper end 150 of the eraser bar 34 to be detached from the glide assembly 90 and swung downward in a manner which allows the cleaning pad 156 of the inner surface 154 to be replaced.

In one embodiment, the upper end 150 of the faceplate 162 of the eraser bar 34 may include a upwardly extending connector plate 190 having a pair of screw openings 192 receiving fasteners 194 therein which may be finger tightened or loosened from the trolley bracket 91 of the glide assembly 90 thereby securing or releasing the upper end 150 of the eraser bar 34 at the upper end 150 to allow the upper end 150 of the eraser bar 34 to pivot downward. The fasteners 194 may be quarter turn fasteners or other known types of screw fasteners.

It is understood that in an alternative embodiment the lower end 152 may be releasably attached to the glide assembly 90 to allow the lower end 152 of the eraser bar 34 to be detached from the glide assembly 90 and swung upward in a manner that allows the cleaning pad 156 of the inner surface 154 to be replaced.

In either configuration, the opposite end of the eraser bar 34 may be hingeably attached as described below allowing the eraser bar 34 to remain attached to the whiteboard 12 while the cleaning pad 156 is being replaced.

Figure 8:
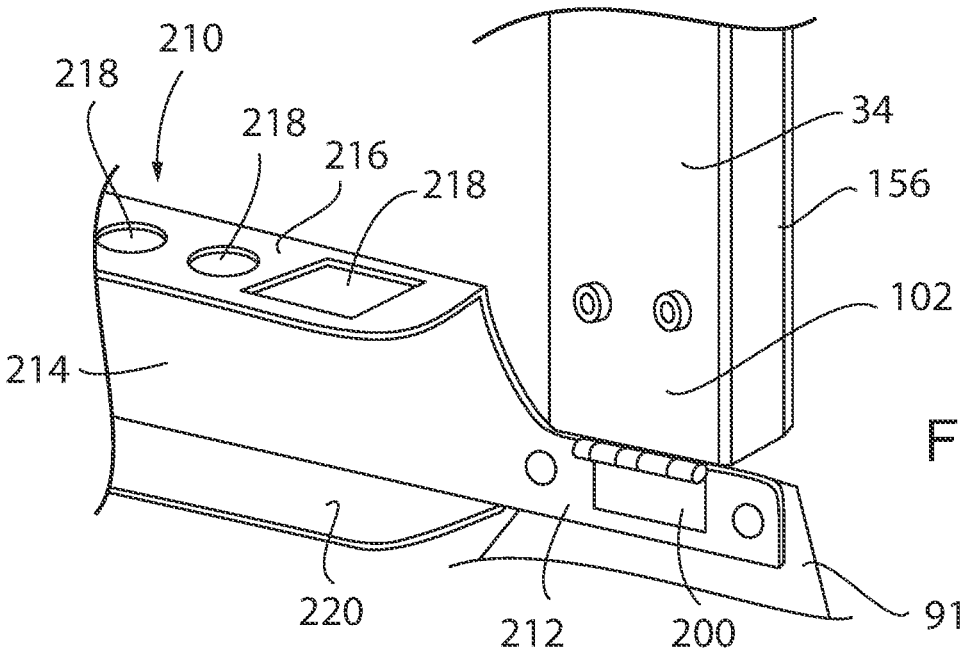
FIG. 8 is an outer perspective view of a bottom of the eraser bar showing a hinge permitting the eraser bar to pivot downward revealing the eraser pad.

Referring to FIGS. 1 and 8, the bottom end 102 of the eraser bar 34 may be attached to the trolley bracket 91 of the glide assembly 90 at a hinge 200 allowing for the eraser bar 34 to pivot away from the whiteboard 12 when the upper end 150 is swung downward thus revealing the inner surface 154 of the eraser bar 34 and allowing the cleaning pad 156 to be replaced.

An accessory holder 210 may be further supported by the glide assembly 90. The accessory holder 210 may include a connector plate 212 attached to the trolley bracket 91 of the glide assembly 90 and extending to a left or right side of the eraser bar 34 to provide a rear plate 214 having a top ledge 216 extending forwardly from an upper edge and having holes 218 shaped to correspond with a cross-sectional shape of the accessories, for example, dry erase markers or a handheld eraser, and a bottom ledge 220 extending forwardly from a lower edge supporting a bottom of these items. The accessory holder 210 may move with the glide assembly 90.

In use, the single sweep eraser system 10 may be used to clean off the nonpermanent markings on the writing surface 14 in a single glide. For example, the eraser bar 34 may be positioned all the way to a left hand side of the whiteboard 12. The user may write on the whiteboard in a left to right manner. Once the entire whiteboard has been written on, the eraser bar 34 may be slid from the left-hand side towards the right hand side a partial distance allowing the user to continue writing on the left-hand side of the whiteboard 12 but leaving the writing on the right-hand side from being erased. The user may continue to slide the eraser bar 34 towards the right-hand side as he or she continues to write from left to right until the eraser bar 34 has reached the right-hand side of the whiteboard 12. The user will then pull the pull handle 174 as the user slides the eraser bar 34 from the right to the left side so that the cleaning pad 156 does not engage the writing surface 14 and leaves the writing on the whiteboard 12 undisturbed. With the eraser bar 34 now on the left-hand side of the whiteboard 12 the user may repeat the pattern by gliding the eraser bar 34 towards the right-hand side a partial distance as he or she continues to write from left to right.

It will be appreciated that the whiteboard 12 may be manufactured with the single sweep eraser system 10 instead of being retrofitted onto an existing whiteboard 12.

It will also be appreciated that the single sweep eraser system 10 may also be arranged so that the eraser bar 34 slides up and down instead of left and right in a similar manner with the upper track bracket 30 and lower track bracket 32 being installed on the left and right edges 20, 22 of the whiteboard 12.

Figure 9:
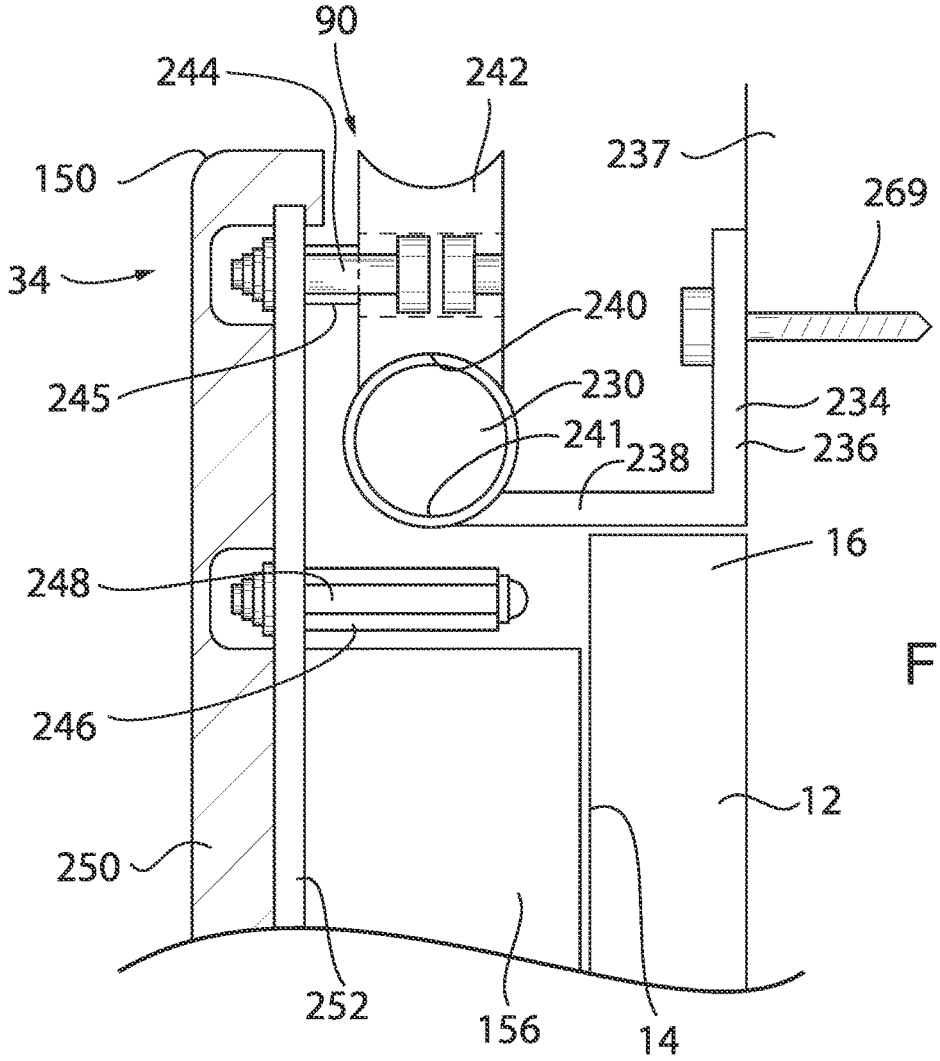
FIG. 9 is a cross-section of an alternative embodiment of the present invention showing the gliding trolley at a top end of the single sweep eraser system gliding along a round tube track bracket.

Referring to FIG. 9, in an alternative embodiment of the present invention, the upper track bracket 30 attached at the upper edge 16 of the whiteboard 12 may be a round tube 230 supported by a bracket 234. The bracket 234 may be an L-shaped bracket having a first vertical arm 236 secured to a wall 237, for example by a fastener 239, above the whiteboard 12 and having a second horizontal arm 238 perpendicular to the first arm 236 and extending outwardly from the wall 236 in close proximity to the upper edge 16 of the whiteboard 12, and supporting the round tube 230 at a distal end. The bracket 234 may be multiple brackets 234 installed incrementally across the width of the whiteboard 12, for example, every approximately 32 inches or where wall studs are located, to assist with the supporting the round tube 230 and the weight of the eraser bar 34.

The round tube 230 may be a tube providing a generally circular cross-section with an unobstructed curved upper surface 240 receiving the glide assembly 90 thereon and an unobstructed curved lower surface 241 contacting the glide assembly 90 therebelow. The round tube 230 may extend approximately a full width of the whiteboard 12 between the left and right edges 20, 22 of the whiteboard 12 to provide a rolling support of the eraser bar 34 along the entire width of the whiteboard 12 but may also include vertically extending stop plates to prevent the glide assembly 90 from rolling off the outer opposed edges of the round tube 230. The round tube 230 may comprise of multiple tube segments that are coupled to form a singular round tube 230.

The glide assembly 90 may include an upper glide having a low friction rolling or sliding surface, such as U groove wheels 242, for example made of polyurethane or rubber and optionally with ball bearings, having a concave surface rolling on and along the curved upper surface 240 of the round tube 230. The wheels 242 of the glide assembly 90 may be supported by an upper end of the eraser bar 34. An axle 244 of the wheels 242 may be supported at the upper end of the eraser bar 34 and extend rearwardly from the eraser bar 34 towards the front writing surface 14 of the whiteboard 12. The axle 244 may include a spacer 245 providing a space between the wheels 242 and the eraser bar 34 to prevent the eraser bar 34 from contacting the round tube 230.

The glide assembly 90 may further include a lower glide having a low friction rolling or sliding surface, such as a tube roller 246 for example made of nylon supported on an axle 248 extending rearwardly from the eraser bar 34 towards the front writing surface 14 of the whiteboard 12 and spaced below the round tube 230 to provide rolling of the tube roller 246 on the curved lower surface 241 of the round tube 230 and to assist with retaining the glide assembly 90 on the round tube 230.

The eraser bar 34 may comprise an outer plate 250 attached to an inner plate 252 by fasteners such as a torx head screw or other type of tamperproof screw. The outer plate 250 may be a plastic cover. The inner plate 252 may support the cleaning pad 156 in generally parallel plane alignment with the front writing surface 14 of the whiteboard 12.

Figure 10:
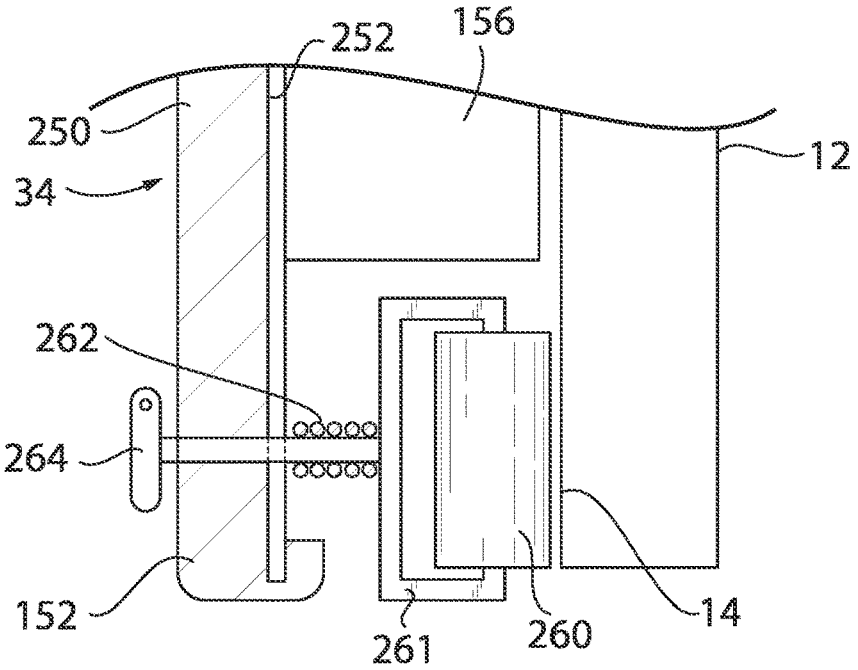
FIG. 10 is a cross-section of the alternative embodiment of the present invention shown in FIG. 9 showing a roller at a bottom end of the single sweep eraser system gliding along the whiteboard outer surface.

Referring to FIG. 10, the lower end 152 of the eraser bar 34 may be permanently unattached from the whiteboard 12. In this respect, the lower end 152 of the eraser bar 34 may include a roller 260 supported by the eraser bar 34 and extending towards the front writing surface 14 of the whiteboard 12 to roll directly along the outer surface of the whiteboard 12. The roller 260 may rotate about an axis parallel to and extending along the height of the front writing surface 14 and provided by a U-shaped bracket 261 extending from the eraser bar 34 rearwardly towards the whiteboard 12. The roller 260 may be a magnetic wheel attracted to the magnetic whiteboard 12. In this respect the eraser bar 34 is attracted to the whiteboard 12 through magnetic forces.

In an alternative embodiment the roller 260 may be a nonmagnetic material such as plastic and/or the whiteboard 12 may be a nonmagnetic material. In this embodiment the user places pressure against the eraser bar 34 towards the whiteboard 12 to press the cleaning pad 156 against the front writing surface 14.

The roller 260 may be further biased towards the whiteboard 12 by a spring 262 in an extended position and may be retracted away from the whiteboard 12 in a retracted position by a lever 264 pulling the roller 260 away from the whiteboard 12.

The upper end 150 of the eraser bar 34 may be pivotable to displace the lower end 152 of the eraser bar 34 from the whiteboard 12. A kickstand (not shown) may be installed between the eraser bar 34 and the whiteboard 12 towards the upper end 150 to retain the eraser bar 34 in a laterally spaced position from the whiteboard 12, for example, to replace the cleaning pad 156 of the eraser bar 34.

In an alternative embodiment of the present invention, the whiteboard 12 may be a blackboard or chalkboard having a porous or nonporous writing surface and on which markings are made with chalk. The blackboard or chalkboard may be a smooth, thin sheet of black or dark grey slate stone. In all other respect, the chalkboard may be used in a similar manner as the whiteboard 12 described above.

Figure 11:
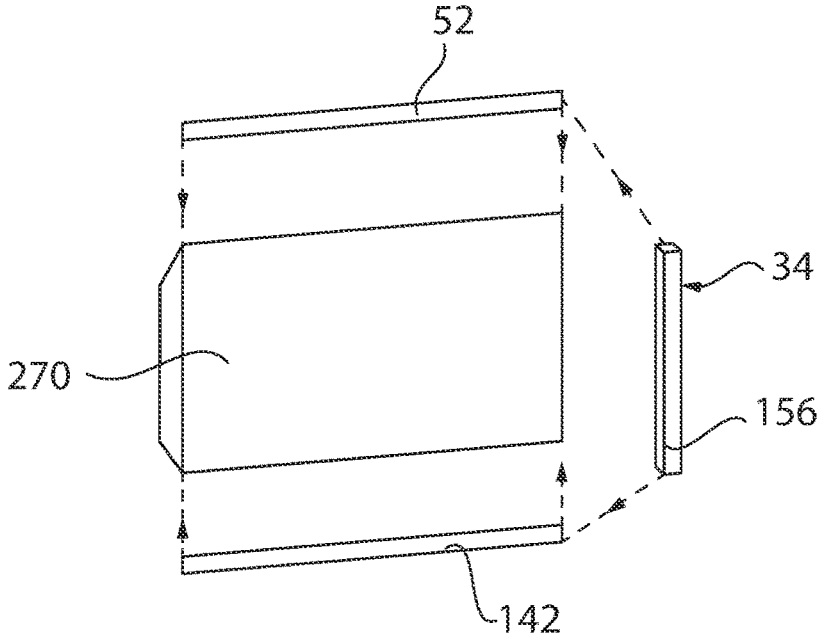
FIG. 11 is a diagram showing the single sweep eraser system being used with a flat-panel video display board.

Referring to FIG. 11, in an alternative embodiment of the present invention, the whiteboard 12 may be a flat panel video display 270 such as a LED or OLED display that uses the single sweep eraser system 10 in a slightly modified form in order to clean the flat panel video display from markings such as dust, dirt and fingerprint smudges. In this respect, the cleaning pad 156 of the eraser bar 34 may be a microfiber cloth contacting the flat panel video display 270. The eraser bar 34 may be optionally detached from the upper track bracket 30 and lower track bracket 32 to allow for the eraser bar 34 to be swept across the flat panel video display 270, independent from the upper rail 52 and lower rail 142. The cleaning pad 156 may be a screen cleaning brush used with a screen cleaning liquid spray, for example water and vinegar solution or water and soap, to facilitate cleaning of the flat panel video display 270.

Figure 12:
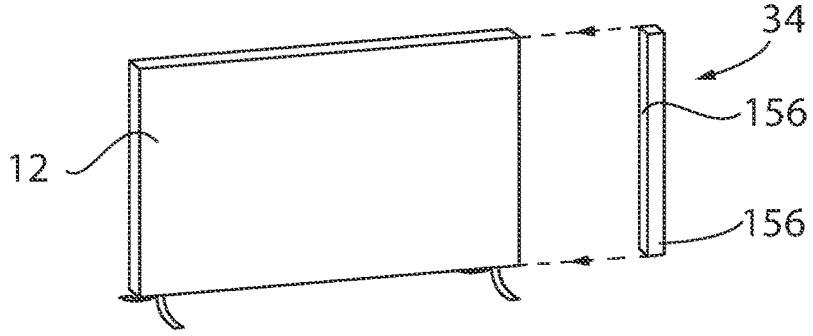
FIG. 12 is a diagram showing use of the eraser bar without attachment to a track assembly of the whiteboard or video display board.

Referring to FIG. 12, in an alternative embodiment of the present invention, the eraser bar 34 may be used without the upper track bracket 30 and lower track bracket 32 such that the eraser bar 34 may be used on any whiteboard 12 or flat panel video display 270 without the upper track bracket 30 and lower track bracket 32 whereby the eraser bar 34 may simply be pushed and pulled along the surface of the whiteboard 12 by the user. The eraser bar 34 may include magnets allowing the eraser bar 34 to be kept on the magnetic whiteboard 12 when not in use.

Figure 13:
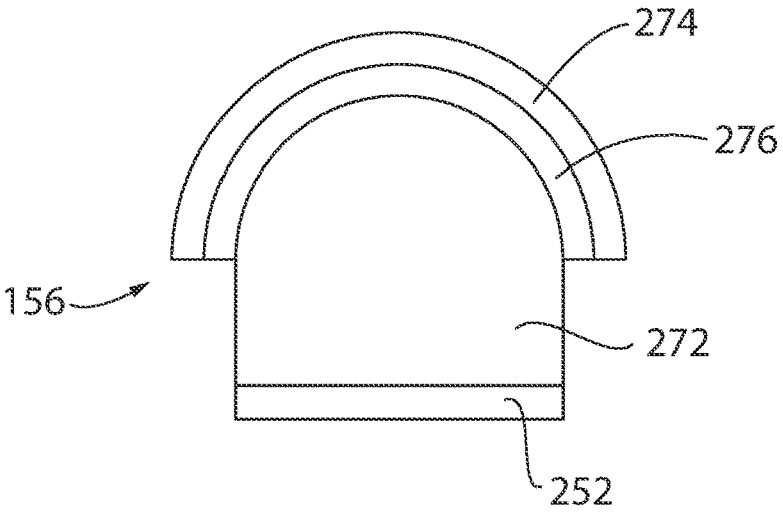
FIG. 13 is a cross section of an alternative embodiment of the cleaning pad of the eraser bar.

Referring to FIG. 13, the cleaning pad 156 may be formed on a semi cylindrical block comprising of a flexible polyurethane foam base 272 attached to the inner plate 252 of the eraser bar 34. The curved outer surface of the foam base 272 may be wrapped by a variety of different cleaning materials 274 depending on the type of surface desired to be cleaned. For example, the cleaning material 274 may be a felt pad for whiteboard erasing or may be easily interchanged with a blackboard eraser for blackboard erasing. The cleaning material 274 may be removably replaced, for example, by a releasable adhesive 276 such as Velcro. The flexible polyurethane foam base 272 compresses and expands, similar to a spring, to help bias the cleaning material 274 towards the whiteboard 12.

It is contemplated that the glide assembly 90 may be motorized so that the eraser bar 34 need not be manual pushed and pulled along the upper rail 52 and lower rail 142 and can be operated to roll along the upper rail 52 and lower rail 142 with an on and off switch.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What I claim is:

1. An eraser system for a writing board having a planar writing surface for an application and removal of markings, the planar writing surface having upper and lower edges terminating at left and right edges comprising:

a track assembly extending along an upper edge of the writing board;

a glide assembly engageable with the track assembly; and an eraser bar assembly having an eraser bar having upper and lower ends extending vertically between the upper and lower edges of the planar writing surface and supported by the glide assembly at the upper end of the eraser bar and configured to be slidable transversely across the writing board along the track assembly and permanently unattached at the lower end of the eraser bar when the glide assembly is engaged with the track assembly;

a contact plate supported by the eraser bar pressable against the planar writing surface, the contact plate releasably supporting an inner cleaning pad contacting the planar writing surface;

a biasing mechanism providing a handgrip permitting a user to apply a biasing force on the contact plate and inner cleaning pad toward the planar writing surface and subsequently remove the biasing force on the contact plate and inner cleaning pad; and a hinge pivotable about an axis of the hinge and joining a first wing coupled to the glide assembly at the upper edge of the writing board and a second wing coupled to the eraser bar, the first and second wings configured to be pivotable about the axis to allow the lower end of the eraser bar to swing upward away from the lower edge of the writing board toward the upper edge of the writing board.

2. The eraser system of claim 1 wherein the inner cleaning pad has a cleaning surface moveable between a cleaning position with the cleaning surface contacting the planar writing surface and a retracted position moved away from the planar writing surface.

3. The eraser system of claim 2 wherein the biasing force moves the contact plate toward the planar writing surface.

4. The eraser system of claim 3 wherein the biasing mechanism are compression springs arranged between the contact plate and the eraser bar.

5. The eraser system of claim 3 wherein the biasing mechanism are magnets of the eraser bar.

6. The eraser system of claim 1 wherein an upper track includes a hanger extending over the upper edge of the writing board to provide front and rear force resistance on the track assembly.

7. The eraser system of claim 1 wherein the glide assembly further comprises glides engageable with the track assembly.

8. The eraser system of claim 7 wherein the glides are at least one wheel engaging opposed forward and rearward walls of the upper track.

9. The eraser system of claim 1 wherein the inner cleaning pad provides multiple layers of eraser material which are separately removable from the cleaning pad.

10. The eraser system of claim 1 wherein the track assembly comprises:

an upper track extending along the upper edge of the writing board and supporting movement of the glide assembly therealong wherein the upper track is a round tube.

11. The eraser system of claim 1 wherein the writing board is a dry erase board having a non-porous planar writing surface.

12. The eraser system of claim 1 wherein the writing board is a chalk board.

13. The eraser system of claim 1 wherein the writing board is a video display screen.

14. A method for removing markings from a writing board having a planar nonporous writing surface, the planar nonporous writing surface having upper and lower edges terminating at left and right edges, the method comprising:

installing a track assembly to extend along an upper edge of the writing board;

attaching an eraser bar having upper and lower ends, extending vertically between the upper and lower edges of the planar nonporous writing surface, to the track assembly, the eraser bar supported by a glide assembly engageable with the track assembly at the upper end of the eraser bar and configured to be slidable transversely across the writing board along the track assembly and permanently unattached at the lower end of the eraser bar when the glide assembly is engaged with the track assembly, the eraser bar supporting a contact plate pressable against the planar nonporous writing surface, the contact plate releasably supporting an inner cleaning pad contacting the planar nonporous writing surface, a biasing mechanism providing a handgrip permitting a user to apply a biasing force on the contact plate and the inner cleaning pad toward the planar nonporous writing surface and subsequently remove the biasing force on the contact plate and inner cleaning pad, a hinge pivotable about an axis of the hinge and joining a first wing coupled to the glide assembly at the upper edge of the writing board and a second wing coupled to the eraser bar, the first and second wings configured to be pivotable about the axis to allow the lower end of the eraser bar to swing upward away from the lower edge of the writing board toward the upper edge of the writing board;

gliding the eraser bar along the planar nonporous writing surface to remove the markings; and pivoting the lower end of the eraser bar away from the lower edge of the writing board and upward toward the upper edge of the writing board.

15. The method of claim 14 further comprising:

moving the inner cleaning pad from a cleaning position with the cleaning pad contacting the writing board to a retracted position moved away from the writing board.

16. The method of claim 14 further comprising:

moving the contact plate against the biasing force away from the planar nonporous writing surface.

* * * * *